US011749445B2

(12) United States Patent
Kato et al.

(10) Patent No.: US 11,749,445 B2
(45) Date of Patent: Sep. 5, 2023

(54) LAMINATED COIL COMPONENT

(71) Applicant: TDK CORPORATION, Tokyo (JP)

(72) Inventors: Hajime Kato, Tokyo (JP); Yuto Shiga, Tokyo (JP); Kazuya Tobita, Tokyo (JP); Youichi Kazuta, Tokyo (JP); Yuya Ishima, Tokyo (JP); Satoru Okamoto, Tokyo (JP); Shunji Aoki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/531,367

(22) Filed: Nov. 19, 2021

(65) Prior Publication Data

US 2022/0076876 A1 Mar. 10, 2022

Related U.S. Application Data

(63) Continuation of application No. 16/046,563, filed on Jul. 26, 2018, now Pat. No. 11,211,192.

(30) Foreign Application Priority Data

Aug. 4, 2017 (JP) ..... 2017-151877

(51) Int. Cl.
*H01F 27/28* (2006.01)
*H01F 17/00* (2006.01)
*H01F 27/29* (2006.01)

(52) U.S. Cl.
CPC ..... *H01F 27/2804* (2013.01); *H01F 17/0013* (2013.01); *H01F 27/292* (2013.01); *H01F 2027/2809* (2013.01)

(58) Field of Classification Search
CPC .. H01F 27/30; H01F 17/0013; H01F 27/2852; H01F 27/292; H01F 27/323; H01F 41/043
See application file for complete search history.

(56) References Cited

U.S. PATENT DOCUMENTS

2007/0188288 A1 8/2007 Ishii
2008/0257488 A1* 10/2008 Yamano ..... H01F 41/122 156/274.2

(Continued)

FOREIGN PATENT DOCUMENTS

CN 103219129 A 7/2013
JP H11-273950 A 10/1999

(Continued)

*Primary Examiner* — Marlon T Fletcher
*Assistant Examiner* — Malcolm Barnes
(74) *Attorney, Agent, or Firm* — Oliff PLC

(57) ABSTRACT

A laminated coil component includes an element body, a coil, and a pair of conductors. The pair of conductors is disposed on the element body. Each of the pair of conductors has an L shape when viewed from the third direction. Each of the pair of conductors includes a first conductor portion and a second conductor portion. The first conductor portion is disposed on one of first side faces. The second conductor portion is disposed on a pair of end faces. The coil includes a first coil portion and a second coil portion. The first coil portion includes a first straight portion and a pair of second straight portions. The pair of second straight portions is connected to both ends of the first straight portion. The second coil portion is curved as a whole.

7 Claims, 8 Drawing Sheets

(56) References Cited

U.S. PATENT DOCUMENTS

| | | | | |
|---|---|---|---|---|
| 2013/0015937 | A1* | 1/2013 | Seko | H01F 41/043 336/200 |
| 2013/0187744 | A1 | 7/2013 | Seko et al. | |
| 2015/0371757 | A1* | 12/2015 | Takezawa | H01F 27/2804 336/200 |
| 2016/0141102 | A1* | 5/2016 | Tseng | H01F 27/292 336/200 |
| 2016/0372261 | A1 | 12/2016 | Ozawa | |
| 2017/0004918 | A1* | 1/2017 | Kido | H01F 27/292 |
| 2017/0103846 | A1* | 4/2017 | Yoneda | H01F 41/122 |
| 2017/0103848 | A1* | 4/2017 | Yoneda | H01F 17/0013 |
| 2017/0133146 | A1* | 5/2017 | Lee | H01F 41/042 |
| 2017/0256352 | A1* | 9/2017 | Kido | H01F 27/2804 |
| 2017/0287620 | A1 | 10/2017 | Miyoshi | |
| 2018/0012700 | A1* | 1/2018 | Lee | H01F 17/0013 |
| 2018/0068780 | A1* | 3/2018 | Shimoda | H01F 17/0013 |
| 2018/0197675 | A1 | 7/2018 | Kido | |

FOREIGN PATENT DOCUMENTS

| | | | |
|---|---|---|---|
| JP | 2002-305111 | A | 10/2002 |
| JP | 2010-165975 | A | 7/2010 |
| JP | 2010-183007 | A | 8/2010 |
| JP | 2013-084856 | A | 5/2013 |
| JP | 2017-073536 | A | 4/2017 |
| WO | 2014/136843 | A1 | 9/2014 |

* cited by examiner

LAMINATED COIL COMPONENT

The present application is a continuation of U.S. application Ser. No. 16/046,563, filed on Jul. 26, 2018, which claims priority to Japanese Application No. 2017-151877, filed on Aug. 4, 2017, the entire disclosures of each of which are hereby incorporated by reference in their entirety.

TECHNICAL FIELD

One aspect of the present invention relates to a laminated coil component.

BACKGROUND

Japanese Unexamined Patent Publication No. 2010-165975 discloses a laminated coil component. The laminated coil component includes an element body, a plurality of coil conductors, and L-shaped conductors. The element body is formed by laminating a plurality of element-body layers. The plurality of coil conductors forms a helical coil in the element body. The conductors are disposed on a mounting surface and end faces of the element body. In this laminated coil component, by disposing the coil conductors along an inner edge of the conductor, an inner diameter of the coil is increased. As a result, a quality (Q) factor is increased.

SUMMARY

In the above laminated coil component, the coil conductors include many corner portions. Thus, signals are reflected at the corner portions, and characteristics of the laminated coil component deteriorate.

One aspect of the present invention is to provide a laminated coil component capable of improving its characteristics.

A laminated coil component according to one aspect of the present invention includes an element body, a coil, and a pair of conductors. The element body has a rectangular parallelepiped shape. The element body includes a pair of end faces, a pair of first side faces, and a pair of second side faces. The pair of end faces is opposed to each other in a first direction. The pair of first side faces is opposed to each other in a second direction orthogonal to the first direction. The pair of second side faces is opposed to each other in a third direction orthogonal to the first direction and the second direction. The element body is formed by laminating a plurality of element-body layers in the third direction. The coil is formed in the element body by a plurality of coil conductors. The coil has a coil axis along the third direction. The pair of conductors is disposed on the element body 2 in such a way as to be apart from each other in the first direction. Each of the pair of conductors has an L shape when viewed from the third direction. Each of the pair of conductors includes a first conductor portion and a second conductor portion. The first conductor portion is disposed on one of the first side faces to be a mounting surface. The second conductor portion is disposed on the pair of end faces in such a way as to be apart from the other of the first side faces. The coil includes a first coil portion and a second coil portion. The first coil portion is disposed closer to the other of the first side faces than an end portion of the second conductor portion at a side of the other of the first side faces. The second coil portion is disposed closer to the one of the first side faces than the end portion. The first coil portion includes a first straight portion and a pair of second straight portions. The pair of second straight portions is connected to both ends of the first straight portion. The second coil portion is curved as a whole.

In this laminated coil component, the element body is formed by laminating a plurality of element-body layers in the third direction. The coil disposed in the element body has a coil axis along the third direction. Each of the pair of conductors has an L shape when viewed from the third direction. Each of the pair of conductors includes a first conductor portion disposed on one of the first side faces and a second conductor portion disposed on the pair of end faces. The first coil portion of the coil is disposed in a region in which the pair of conductors is not disposed, that is, in a region closer to the other of the first side faces than the end portion of the second conductor portion at the side of the other of the first side faces. The first coil portion includes a first straight portion and a pair of second straight portions. The element body has a rectangular parallelepiped shape. Thus, the first coil portion includes such straight portions and is disposed along the outer edge of the element body when viewed from the third direction, and it is thereby possible to increase an inner diameter of the coil. The second coil portion of the coil is disposed in a region in which the pair of conductors is disposed, that is, in a region closer to the one of the first side faces than the end portion of the second conductor portion at the side of the other of the first side faces. The second coil portion is curved as a whole. Therefore, the second coil portion can be disposed in such a way as to avoid the pair of conductors even if the second coil portion does not include a corner portion. As described above, in this laminated coil component, it is possible to suppress signal reflection at the corner portion while increasing the inner diameter of the coil. Thus, it is possible to improve the characteristics.

In this laminated coil component, the second coil portion may include an arcuate curved portion. In this case, the second coil portion does not include a corner portion. Accordingly, it is possible to further suppress signal reflection.

In this laminated coil component, the second coil portion may include a plurality of straight portions and a curved portion connecting the plurality of straight portions to each other. In this case, the shape of the second coil portion is more flexible as compared to the case in which the second coil portion includes only the curved portion. Accordingly, it is possible to increase the inner diameter of the coil while the second coil portion is away from the pair of conductors by a certain distance or more.

In this laminated coil component, a pair of coil conductors adjacent to each other in the third direction among the plurality of coil conductors may be disposed in such a way as to at least partially overlap each other when viewed from the third direction. In this case, it is possible to more smoothly connect the plurality of coil conductors to each other than the case of being connected by through-hole conductors. Accordingly, it is possible to further suppress signal reflection.

DETAILED DESCRIPTION

Hereinafter, embodiments will be described in detail with reference to the accompanying drawings. In the following description, the same reference sign is assigned to the same element or the element having the same function, and the redundant description will be omitted.

First Embodiment

Figure 1:
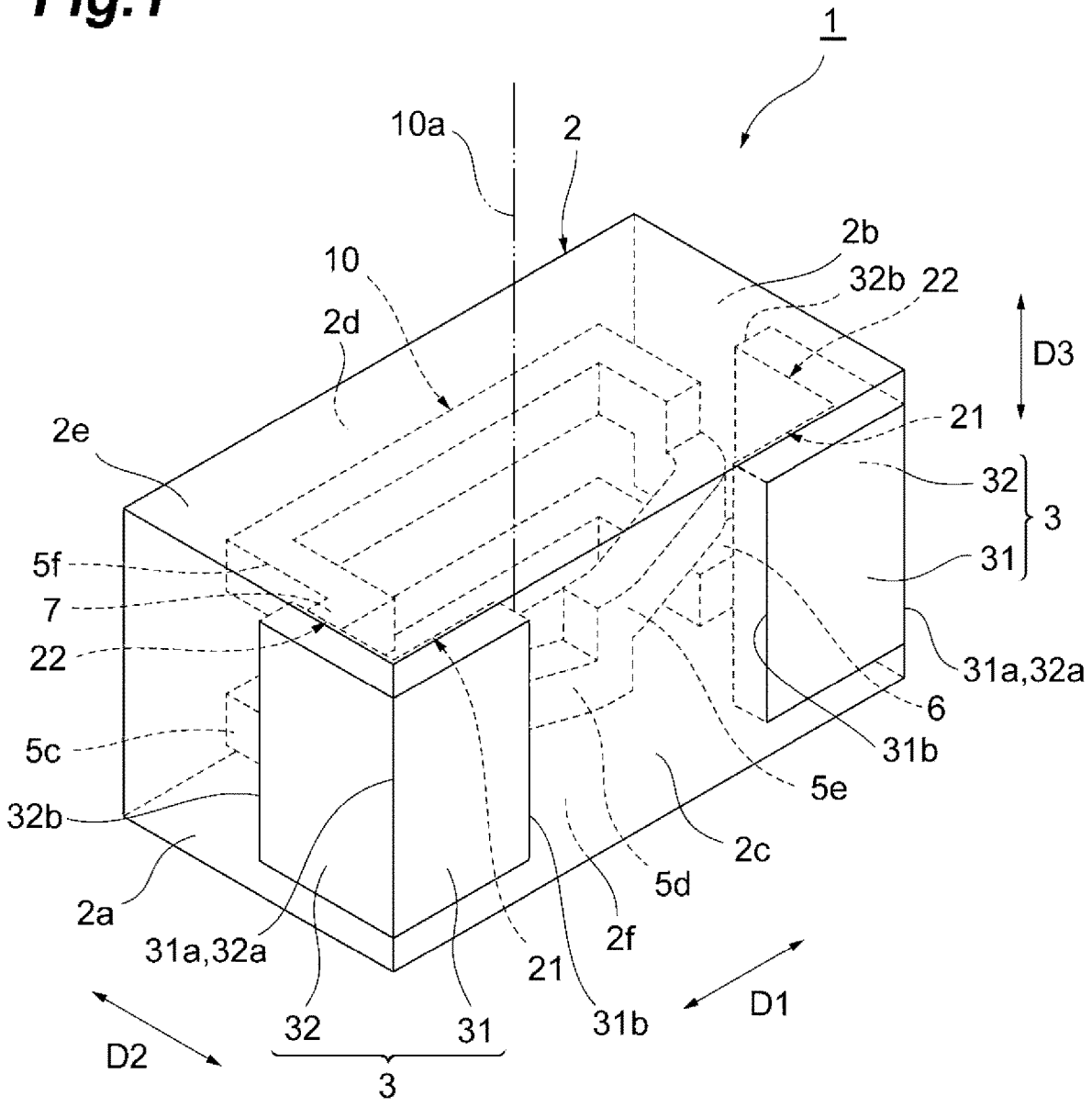
FIG. 1 is a perspective view of a laminated coil component according to a first embodiment.
Figure 2:
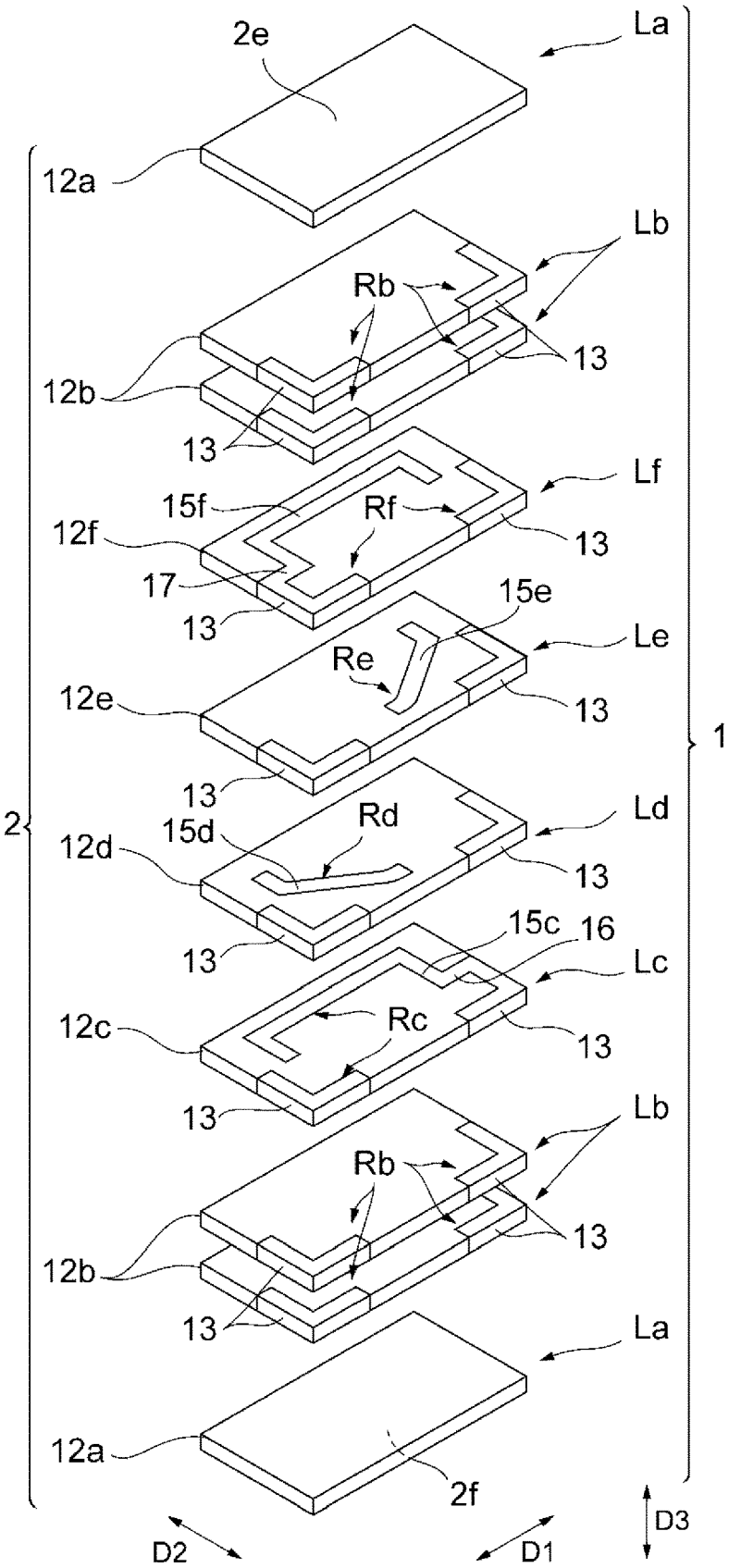
FIG. 2 is an exploded perspective view of the laminated coil component in FIG. 1.

FIG. 1 is a perspective view of the laminated coil component according to the first embodiment. FIG. 2 is an exploded perspective view of the laminated coil component in FIG. 1. With reference to FIGS. 1 and 2, a laminated coil component 1 according to the first embodiment includes an element body 2, a pair of conductors 3, a coil 10 constituted by a plurality of coil conductors 5*c*, 5*d*, 5*e*, and 5*f*, and connecting conductors 6 and 7.

The element body 2 has a rectangular parallelepiped shape. The rectangular parallelepiped shape includes a rectangular parallelepiped shape in which the corner portions and the ridge portions are chamfered, and a rectangular parallelepiped shape in which the corner portions and the ridge portions are rounded. The element body 2 has end faces 2*a* and 2*b*, and side faces 2*c*, 2*d*, 2*e*, and 2*f*. The end faces 2*a* and 2*b* are opposed to each other. The side faces 2*c* and 2*d* are opposed to each other. The side faces 2*e* and 2*f* are opposed to each other. In the following description, it is assumed that the opposing direction of the end faces 2*a* and 2*b* is a direction D1, that the opposing direction of the side faces 2*c* and 2*d* is a direction D2, and that the opposing direction of the side faces 2*e* and 2*f* is a direction D3. The direction D1, the direction D2, and the direction D3 are orthogonal to each other.

The end faces 2*a* and 2*b* extend in the direction D2 in such a way as to connect the side faces 2*c* and 2*d*. The end faces 2*a* and 2*b* also extend in the direction D3 in such a way as to connect the side faces 2*e* and 2*f*. The side faces 2*c* and 2*d* extend in the direction D1 in such a way as to connect the end faces 2*a* and 2*b*. The side faces 2*c* and 2*d* also extend in the direction D3 in such a way as to connect the side faces 2*e* and 2*f*. The side faces 2*e* and 2*f* extend in the direction D2 in such a way as to connect the side faces 2*c* and 2*d*. The side faces 2*e* and 2*f* also extend in the direction D1 in such a way as to connect the end faces 2*a* and 2*b*. The side face 2*c* is a mounting surface and is opposed to another electronic device, which is not shown, (for example, a circuit substrate or a laminated coil component) when, for example, the laminated coil component 1 is mounted on the electronic device. The side face 2*c* is adjacent to the end faces 2*a* and 2*b* and the side faces 2*e*, 2*f*.

The length of the element body 2 in the direction D1 is longer than the length of the element body 2 in the direction D2 and the length of the element body 2 in the direction D3. The length of the element body 2 in the direction D2 and the length of the element body 2 in the direction D3 are equivalent to other. That is, in the present embodiment, the end faces 2*a* and 2*b* each have a square shape, and the side faces 2*c*, 2*d*, 2*e*, and 2*f* each have a rectangular shape. The length of the element body 2 in the direction D1 may be equivalent to the length of the element body 2 in the direction D2 and to the length of the element body 2 in the direction D3, or may be shorter than these lengths. The length of the element body 2 in the direction D2 and the length of the element body 2 in the direction D3 may be different from each other.

In the present embodiment, the term "equivalent" may include, in addition to being equal, a value including a slight difference or a manufacturing error in a preset range. For example, if a plurality of values is included within the range of +5% of the average value of the values, the values are defined to be equivalent.

The outer face of element body 2 is provided with a pair of depressions 21 and a pair of depressions 22. One depression 21 is provided on the end face 2*a* side of the side face 2*c* and is depressed toward the side face 2*d*. The other depression 21 is provided on the end face 2*b* side of the side face 2*c* and is depressed toward the side face 2*d*. One depression 22 is provided on the end face 2*c* side of the side face 2*a* and is depressed toward the side face 2*b*. The other depression 22 is provided on the end face 2*c* side of the side face 2*b* and is depressed toward the side face 2*a*.

The other depression 21 and the other depression 22 are continuously provided and correspond to one conductor 3. The other depression 21 and the other depression 22 are continuously provided and correspond to the other conductor 3. The depressions 21 and 22 have, for example, the same shape. The pair of depressions 21 is provided apart from each other in the direction D1.

The element body 2 is formed by laminating a plurality of element-body layers 12*a*, 12*b*, 12*c*, 12*d*, 12*e* and 12*f* in the direction D3. In other words, the lamination direction of the plurality of element body layers 12*a* to 12*f* is the direction D3. A specific laminated structure will be described later. In the actual element body 2, the element-body layers 12*a* to 12*f* are integrated in such a way that no boundaries between the layers can be visually recognized. The element-body layers 12*a* to 12*f* are formed of, for example, a magnetic material (Ni—Cu—Zn-based ferrite material, Ni—Cu—Zn—Mg-based ferrite material, Ni—Cu-based ferrite material, or the like). The magnetic material forming the element-body layers 12*a* to 12*f* may contain Fe alloy or the like. The element-body layers 12*a* to 12*f* may be formed of a non-magnetic material (a glass ceramic material, a dielectric material, or the like).

The pair of conductors 3 is provided on the element body 2. Specifically, the pair of conductors 3 is disposed in the pair of depressions 21 and the pair of depressions 22. The pair of depressions 21 and the pair of depressions 22 are provided on the outer face of the element body 2. The pair of conductors 3 is exposed on the outer surface of the element body 2. More specifically, the one conductor 3 is disposed in the one depression 21 and the one depression 22, and the other conductor 3 is disposed in the other depression 21 and the other depression 22. The conductors 3 are separated from each other in the direction D1. Each conductor 3 is formed by laminating a plurality of conductor layers 13 in the direction D3. That is, the lamination direction of the conductor layers 13 is the direction D3. In the actual conductor 3, the conductor layers 13 are integrated in such a way that no boundaries between the layers can be visually recognized.

When viewed from the direction D3, each conductor 3 has an L shape. Each conductor 3 includes a conductor portion 31 and a conductor portion 32 which are integrally provided. When viewed from the direction D3, the conductor portion 31 extends in the direction D1 and the conductor portion 32 extends in the direction D2. The conductor portion 31 is disposed in the depression 21 provided on the side face 2*c* in such a way as to be apart from the side faces 2*e* and 2*f*. The conductor portion 32 is disposed in the depression 22 provided on each of the end faces 2*a* and 2*b* in such a way as to be apart from the side faces 2*d*, 2*e*, and 2*f*.

The conductor portions 31 and 32 each have a substantially rectangular plate shape. Each of the pair of conductors 3 has the same shape. Note that, the L shape may be any shape as long as it is a substantially L shape as a whole. For example, the L shape may have depressions and projections provided on the surface of each conductor 3 as long as it is a substantially L shape as a whole.

Figure 8:
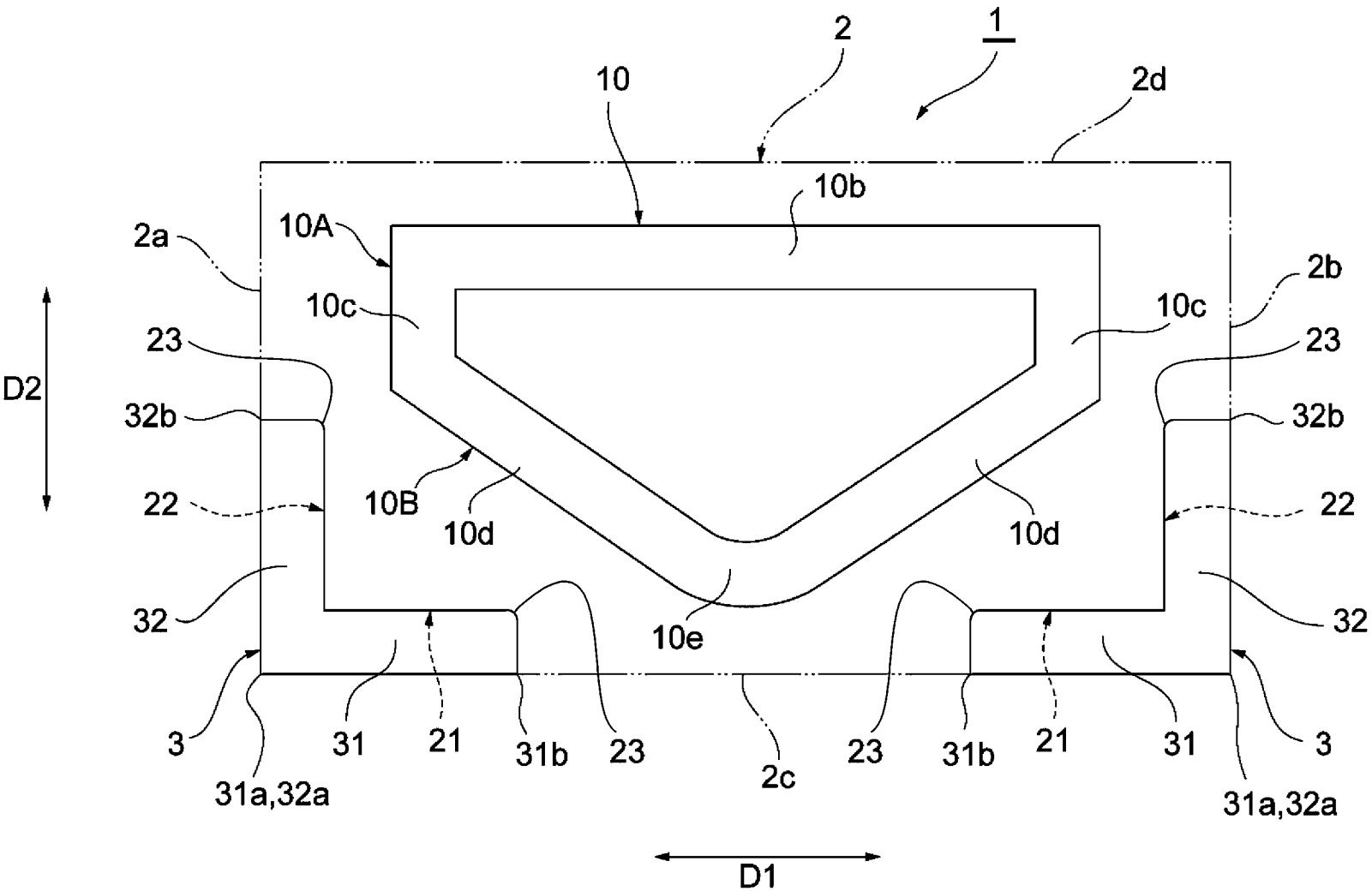
FIG. 8 is an alternate view of the FIG. 3 embodiment that illustrates rounded corner portions.

The conductor portion 31 includes an end portion 31*a* and an end portion 31*b* which are opposed to each other in the direction D2. The conductor portion 32 includes an end portion 32*a* and an end portion 32*b* which are opposed to each other in the direction D3. The end portion 31*a* and the end portion 32*a* are connected to each other and integrally provided. Corner portions disposed in the element body 2 at the end portion 31*b* and the end portion 32*b* may have rounded shapes 23, as shown in FIG. 8. In other words, the bottom faces of the depression 21 and the depression 22 may be curved at the end portion 31*b* and the end portion 32*b* respectively.

Each conductor 3 may be provided with a plating layer (not shown) containing, for example, Ni, Sn, Au, or the like by electrolytic plating or electroless plating. The plating layer may include, for example, a Ni plating film containing Ni and covering the conductor 3, and an Su plating film containing Su and covering the Ni plating film.

The coil conductors 5*c* to 5*f* are connected to each other in the element body 2 to form a coil 10 shown in FIG. 1. The coil 10 has a coil axis 10*a* along the direction D3. The coil conductors 5*c*, 5*d*, 5*e*, and 5*f* are disposed in such a way as to be separated from the end faces 2*a* and 2*b* and the side faces 2*c*, 2*d*, 2*e*, and 2*f*.

Among the coil conductors 5*c* to 5*f*, a pair of coil conductors adjacent to each other in the direction D3 is disposed in such a way as to at least partially overlap each other when viewed from the direction D3. Specifically, the coil conductors 5*c* and 5*d* adjacent to each other in the direction D3 are disposed in such a way as to at least partially overlap each other when viewed from the direction D3. The coil conductors 5*d* and 5*e* adjacent to each other in the direction D3 are disposed in such a way as to at least partially overlap each other when viewed from the direction D3. The coil conductors 5*e* and 5*f* adjacent to each other in the direction D3 are disposed in such a way as to at least partially overlap each other when viewed from the direction D3.

The coil conductors 5*c* to 5*f* are constituted by a group of coil conductor layer 15*c*, 15*d*, 15*e*, and 15*f*. The coil conductors 5*c* to 5*f* may be constituted by laminating a plurality of groups of coil conductor layers 15*c*, 15*d*, 15*e*, and 15*f* in the direction D3. In this case, the groups of the coil conductor layers 15*c* to 15*f* are disposed in such a way as to entirely overlap each other when viewed from the direction D3. In this manner, by laminating the groups of coil conductor layers 15*c* to 15*f*, it is possible to increase the aspect ratio of the coil conductors 5*c* to 5*f* and to improve the Q-value of the coil 10.

The connecting conductor 6 extends in the direction D1. The connecting conductor 6 is connected to the coil conductor 5*c* and another conductor portion 32. The connecting conductor 7 extends in the direction D1. The connecting conductor 7 is connected to the coil conductor 5*f* and the one conductor portion 32. The connecting conductors 6 and 7 are constituted by a group of connecting conductor layers 16 and 17. The connecting conductors 6 and 7 may be constituted by laminating a plurality of groups of connecting conductor layers 16 and 17 in the direction D3. In this case, the groups of the connecting conductor layers 16 and 17 are disposed in such a way as to entirely overlap each other when viewed from the direction D3.

The conductor layers 13, the coil conductor layers 15*c*, 15*d*, 15*e*, and 15*f*, and the connecting conductor layers 16 and 17 includes a conductive material (for example, Ag or Pd). Each layer may include the same material or different materials.

The laminated coil component 1 has layers La, Lb, Lc, Ld, Le, and Lf. For example, the laminated coil component 1 is constituted by laminating, from the side face 2*f* side, one layer La, two layers Lb, one layer Lc, one layer Ld, one layer Le, one layer Lf, two layers Lb, and one layer La, in this order.

The layer La is constituted by the element-body layer 12*a*.

The layer Lb is constituted by combining the element-body layer 12*b* and a pair of conductor layers 13 with each other. The element-body layer 12*b* is provided with a defect portion Rb. The defect portion Rb has shapes corresponding to the respective shapes of the pair of conductor layers 13. The pair of conductor layers 13 is fitted into the defect portion Rb. The element-body layer 12*b* and the pair of conductor layers 13 have mutually complementary relationship as a whole.

The layer Lc is constituted by combining the element-body layer 12*c*, a pair of conductor layers 13, the coil conductor layer 15*c*, and the connecting conductor layer 16 with each other. The element-body layer 12*c* is provided with a defect portion Rc. The defect portion Rc has shapes corresponding to the respective shapes of the pair of conductor layers 13, the coil conductor layer 15*c*, and the connecting conductor layer 16. The pair of the conductor layers 13, the coil conductor layer 15*c*, and the connecting conductor layer 16 are fitted into the defect portion Rc. The element-body layer 12*c*, the pair of conductor layers 13, the coil conductor layer 15*c*, and the connecting conductor layer 16 have mutually complementary relationship as a whole.

The layer Ld is constituted by combining the element-body layer 12*d*, the pair of conductor layers 13 and the coil conductor layer 15*d* with each other. The element-body layer 12*d* is provided with a defect portion Rd. The defect portion Rd has shape corresponding to the shape of the pair of conductor layers 13 and the coil conductor layer 15*d*. The pair of conductor layers 13 and the coil conductor layer 15*d* and fitted into the defect portion Rd. The element-body layer 12*d*, the pair of conductor layers 13, and the coil conductor layer 15*d* have mutually complementary relationship as a whole.

The layer Le is constituted by combining the element-body layer 12*e*, the pair of conductor layers 13, and the coil conductor layer 15*e* with each other. The element-body layer 12*e* is provided with a defect portion Re. The defect portion Re has shape corresponding to the shapes of the pair of conductor layers 13 and the coil conductor layer 15*e*. The pair of conductor layers 13 and the coil conductor layer 15*e* are fitted into the defect portion Re. The element-body layer 12*e*, the pair of conductor layers 13, and the coil conductor layer 15*e* have mutually complementary relationship as a whole.

The layer Lf is constituted by combining the element-body layer 12*f*, a pair of conductor layers 13, the coil conductor layer 15*f*, and the connecting conductor layer 17 with each other. The element-body layer 12*f* is provided with a defect portion Rf. The defect portion Rf has shapes corresponding to the respective shapes of the pair of conductor layers 13, the coil conductor layer 15*f*, and the connecting conductor layer 17. The pair of the conductor layers 13, the coil conductor layer 15*f*, and the connecting conductor layer 17 are fitted into the defect portion Rf. The element-body layer 12*f*, the pair of conductor layers 13, the coil conductor layer 15*f*, and the connecting conductor layer 17 have mutually complementary relationship as a whole.

The widths of the defect portions Rb, Rc, Rd, Re, and Rf (hereinafter, the width of the defect portion) are basically set in such a way as to be wider than the those of the conductor layers 13, the coil conductor layers 15*c*, 15*d*, 15*e*, and 15*f*, and the connecting conductor layers 16 and 17 (hereinafter, the width of the conductor portion). The width of the defect portion may be intentionally set in such a way as to be narrower than the width of the conductor portion in order for the element-body layers 12*b*, 12*c*, 12*d*, 12*e*, and 12*f* to adhere to the conductor layers 13, the coil conductor layers 15*c*, 15*d*, 15*e*, and 15*f*, and the connecting conductor layers 16 and 17 more firmly. The value obtained by subtracting the width of the conductor portion from the width of the defect portion is preferably, for example, −3 μm or more and 10 μm or less, and more preferably 0 μm or more and 10 μm or less.

Figure 3:
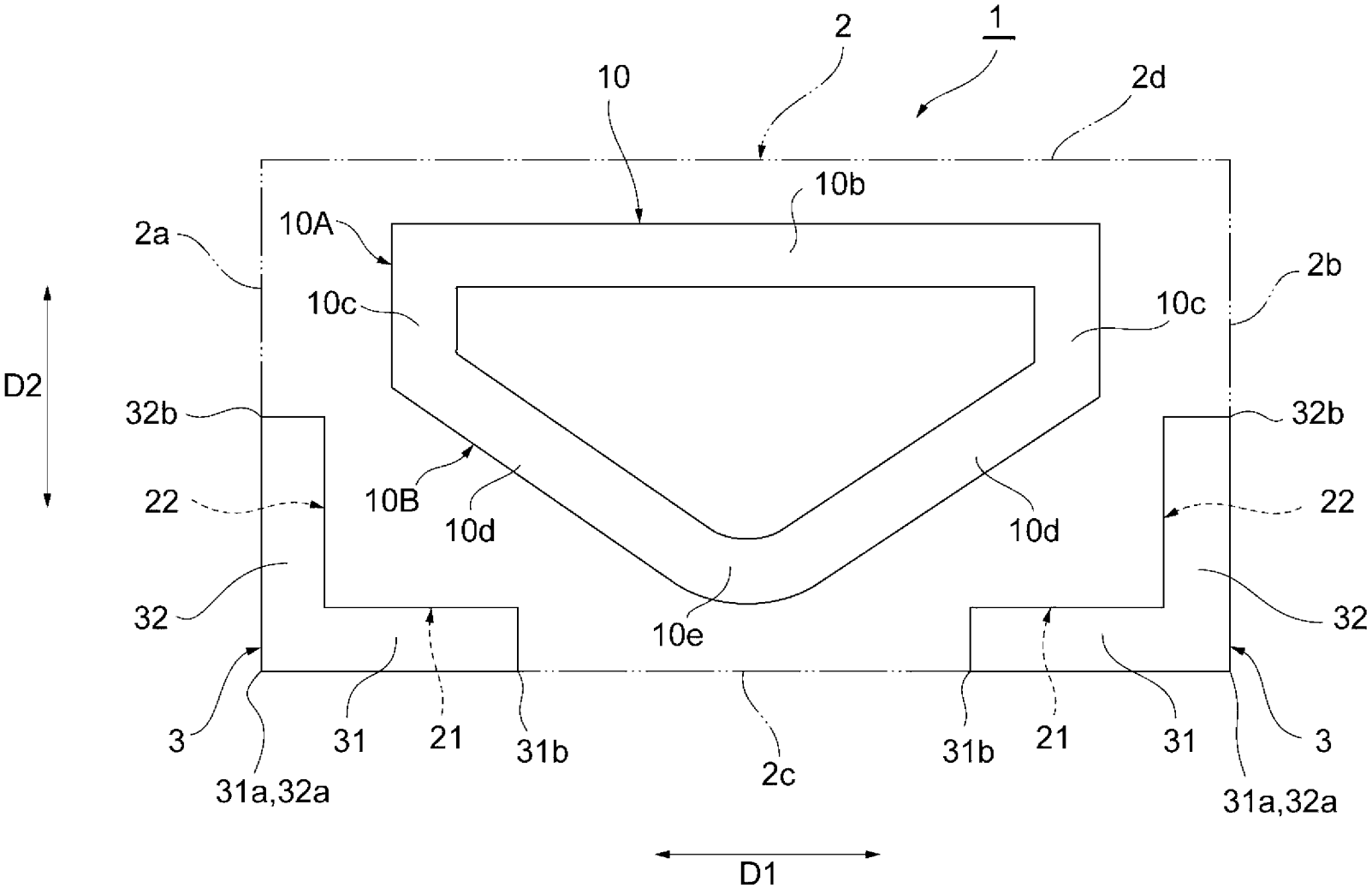
FIG. 3 is a side view of the laminated coil component in FIG. 1 when viewed from a direction along a coil axis.

FIG. 3 is a side view of the laminated coil component in FIG. 1 when viewed from a direction along the coil axis. In FIG. 3, in order to explain the disposition of the coil 10 and the conductors 3, the element body 2 is indicated by imaginary lines, the illustration of the connecting conductors 6 and 7 is omitted, and the coil 10 is indicated by the outline when viewed from the direction along the coil axis 10*a* (see FIG. 1), that is, the direction D3. The outline of the coil 10 is formed by the edges (the inner edge and the outer edge of the coil 10) of the coil conductors 5*c* to 5*f* (see FIG. 1) in the width direction, and the edges of the coil conductors Sc to 5*f* in the extending direction are not shown.

As shown in FIG. 3, the coil 10 includes a straight portion 10*b*, a pair of straight portions 10*c*, a pair of straight portions 10*d*, and a curved portion 10*e*.

The straight portion 10*b* has a linear shape and extends along the direction D1. The straight portion 10*b* is disposed along the side face 2*d*. The length of the straight portion 10*b* in the direction D1 is 30% or more and 98% or less of the length of the element body 2 in the direction D1, and more preferably 60% or more and 98% or less. The straight portion 10*b* is disposed in the center portion of the element body 2 in the direction D1. That is, the distance between the straight portion 10*b* and the end face 2*a* in the direction D1 is equal to the distance between the straight portion 10*b* and the end face 2*b* in the direction D1. The distance between the straight portion 10*b* and the side face 2*d* in the direction D2 is 1.5% or more and 30% or less of the length of the element body 2 in the direction D2, and more preferably 1.5% or more and 10% or less.

The pair of straight portions 10*c* is connected to the straight portion 10*b*. Specifically, the end portion of one straight portion 10*c* at the side face 2*d* side is connected to the end portion of the straight portion 10*b* at the end face 2*a* side. The end portion of the other straight portion 10*c* at the side face 2*d* side is connected to the end portion of the straight portion 10*b* at the end face 2*b* side. Each of the pair of straight portions 10*c* has a linear shape and extends along the direction D2. Each of the pair of straight portions 10*c* has the same shape. The one straight portion 10*c* is disposed along the end face 2*a*. The other straight portion 10*c* is disposed along the end face 2*b*. The distance between the one straight portion 10*c* and the end face 2*a* in the direction D1 is equal to the distance between the straight portion 10*b* and the end face 2*a* in the direction D1. The distance between the other straight portion 10*c* and the end face 2*b* in the direction D1 is equal to the distance between the straight portion 10*b* and the end face 2*b* in the direction D1.

The pair of straight portions 10*d* is connected to the pair of straight portions 10*c*. Specifically, the end portion of one straight portion 10*d* at the side face 2*d* side is connected to the end portion of the one straight portion 10*c* at the side face 2*c* side. The end portion of the other straight portion 10*d* at the side face 2*d* side is connected to the end portion of the other straight portion 10*c* at the side face 2*c* side. Each of the pair of straight portions 10*d* has a linear shape and extends from the end portion of each of the pair of straight portions 10*c* at the side face 2*c* side toward the side face 2*c*. The pair of straight portions 10*d* is disposed such that the straight portions 10*d* are closer with each other toward the side face 2*c*. Toward the side face 2*c*, the distance between the one straight portion 10*d* and the end face 2*a* in the direction D1 and the distance between the other straight portion 10*d* and the end face 2*b* in the direction D1 become longer. Each of the pair of straight portions 10*d* has the same shape.

The curved portion 10*e* connects the pair of straight portions 10*d* to each other. Specifically, the end portion of the curved portion 10*e* at the end face 2*a* side is connected to the end portion of the one straight portion 10*d* at the side face 2*c* side. The end portion of the curved portion 10*e* at the end face 2*b* side is connected to the end portion of the other straight portion 10*d* at the side face 2*c* side. The curved portion 10*e* is disposed in the center portion of the element body 2 in the direction D1. The curved portion 10*e* is curved in such a way that the side face 2*d* side is to be the inside of the curve and the side face 2*c* side is to be the outside of the curve. The curved portion 10*e* is curved in such a way that the top portion of the curve is to be positioned between end portions 31*b* of the pair of conductors 3. Thus, the inner diameter of the coil 10 can be increased.

The straight portion 10*b* is formed by a part of the coil conductor 5*c* and a part of the coil conductor 5*f*. The one straight portion 10*c* is formed by a part of the coil conductor 5*c*, a part of the coil conductor 5*d*, and a part of the coil conductor 5*f*. The other straight portion 10*c* is formed by a part of the coil conductor 5*c*, a part of the coil conductor 5*e*, and a part of the coil conductor 5*f*. The one straight portion 10*d* is formed by a part of the coil conductor 5*d*. The other straight portion 10*d* is formed by a part of the coil conductor 5*e*. The curved portion 10*e* is formed by a part of the coil conductor 5*d* and a part of the coil conductor 5*e*.

The coil 10 includes coil portions 10A and 10B. The coil portion 10A is, in the coil 10, the portion disposed closer to the side face 2*d* than the end portion of the conductor portion 32 at the side face 2*d* side, that is, the end portion 32*b*. The coil portion 10B is, in the coil 10, the portion disposed closer to the side face 2*c* than the end portion 32*b*. The coil portion 10A includes the straight portion 10*b* and the pair of straight portions 10*c*. The coil portion 10B is formed by the pair of straight portions 10*d* and the curved portion 10*e*. The coil portion 10B is curved as a whole.

An example of a method for manufacturing the laminated coil component 1 according to the first embodiment is described.

First, an element-body paste containing the constituent material of the element-body layers 12*a* to 12*f* and a photosensitive material is applied on a substrate (for example, a PET film). An element-body forming layer is thereby formed. The photosensitive material contained in the element-body paste may be either a negative type or a positive type, and a known photosensitive material can be used. Then, the element-body forming layer is exposed and developed by, for example, a photolithography method using a Cr mask. An element-body pattern from which a shape corresponding to the shape of a conductor forming layer to be described later is removed is thereby formed on the substrate. The element-body pattern is a layer to be each of the element-body layers 12*b*, 12*c*, 12*d*, 12*e*, and 12*f* after heat treatment. That is, the element-body pattern provided with defect portions to be the defect portions Rb, Rc, Rd, Re, and Rf is formed. Note that, the "photolithography method" in the present embodiment is only required to be a method for forming a desired pattern by exposing and developing a layer to be patterned containing a photosensitive material, and is not limited to the type of mask or the like.

On the other hand, a conductor paste containing the constituent materials of the above conductor layer 13, the coil conductor layers 15*c*, 15*d*, 15*e*, and 15*f*, and the connecting conductor layers 16 and 17, and a photosensitive material is applied on a substrate (for example, a PET film). A conductor forming layer is thereby formed. The photosensitive material contained in the conductor paste may be either a negative type or a positive type, and a known photosensitive material can be used. Then, the conductor forming layer is exposed and developed by, for example, a photolithography method using a Cr mask. A conductor pattern is thereby formed on the substrate. The conductor pattern is a layer to be each of the conductor layer 13, the coil conductor layers 15*c*, 15*d*, 15*e*, and 15*f*, and the connecting conductor layers 16 and 17 after the heat treatment.

Then, the element-body forming layer is transferred from the substrate onto a supporting body. The layer La after the heat treatment is thereby formed.

Then, the conductor pattern and the element-body pattern are repeatedly transferred onto the supporting body. The conductor patterns and the element-body patterns are thereby laminated in the direction D3. Specifically, first, the conductor pattern is transferred from the substrate onto the element-body forming layer. Next, the element-body pattern is transferred from the substrate onto the element-body forming layer. The conductor pattern is combined with the defect portion of the element-body pattern, and the element-body pattern and the conductor pattern are in the same layer on the element-body forming layer. The step of transferring the conductor pattern and element-body pattern is further repeated. The conductor pattern and the element-body pattern are thereby laminated in a state of being combined with each other. The layers to be the layers Lb, Lc, Ld, Le, and Lf after the heat treatment are thereby laminated.

Then, the element-body forming layer is transferred from the substrate onto the layers laminated in the steps of transferring the conductor pattern and the element-body pattern. The layer La after the heat treatment is thereby laminated.

As described above, a laminate constituting the laminated coil component 1 is formed on the supporting body after the heat treatment. Then, the obtained laminate is cut into a predetermined size. Thereafter, the cut laminate is subjected to debinding treatment, and then subjected to the heat treatment. The temperature of the heat treatment is, for example, about 850 to 900° C. The laminated coil component 1 is thereby obtained. As necessary, the conductor 3 may be provided with a plating layer by electrolytic plating or electroless plating after the heat treatment.

As described above, in the laminated coil component 1, the element body 2 is formed by laminating a plurality of element-body layers 12*a* to 12*f* in the direction D3, and the coil 10 disposed in the element body 2 has the coil axis 10*a* along the direction D3. Each of the pair of conductors 3 has an L shape when viewed from the direction D3 and includes the conductor portion 31 disposed on the side face 2*c* and the conductor portion 32 disposed on each of the end faces 2*a* and 2*b*. The coil portion 10A is disposed in a region in which the pair of conductors 3 is not disposed, that is, in a region closer to the side face 2*d* than the end portion 32*b*. The coil portion 10A includes the straight portion 10*b* and the pair of straight portions 10*c*. The element body 2 has a rectangular parallelepiped shape. Since the coil portion 10A includes such the straight portions 10*b* and 10*c* and is disposed along the outer edge of the element body 2 when viewed from the direction D3, and it is possible to increase the inner diameter of the coil 10. The coil portion 10B is disposed in a region in which the pair of conductors 3 is disposed, that is, in a region closer to the side face 2*c* that the end portion 32*b*. The coil portion 10B is curved as a whole. Therefore, the coil portion 11B can be disposed in such a way as to avoid the pair of conductors 3 even if the coil portion 10B does not include a corner portion. As described above, in the laminated coil component 1, it is possible to suppress signal reflection at the corner portion while increasing the inner diameter of the coil 10. Thus, it is possible to improve the characteristics.

In the laminated coil component 1, the coil portion 10B includes the pair of straight portions 10*d* and the curved portion 10*e*. Thus, the shape of the coil portion 10B is more flexible as compared to the case in which the coil portion 10B includes only the curved portion. Accordingly, it is possible to increase the inner diameter of the coil 10 while the coil portion 10B is away from the pair of conductors 3 by a certain distance or more and the short circuit is suppressed.

In the laminated coil component 1, among the coil conductors 5*c* to 5*f*, a pair of coil conductors adjacent to each other in the direction D3 is disposed in such a way as to at least partially overlap each other when viewed from the direction D3. Thus, it is possible to more smoothly connect the plurality of coil conductors 5*c* to 5*f* to each other as compared to the case of being connected by through-hole conductors. Accordingly, it is possible to further suppress signal reflection.

Second Embodiment

Figure 4:
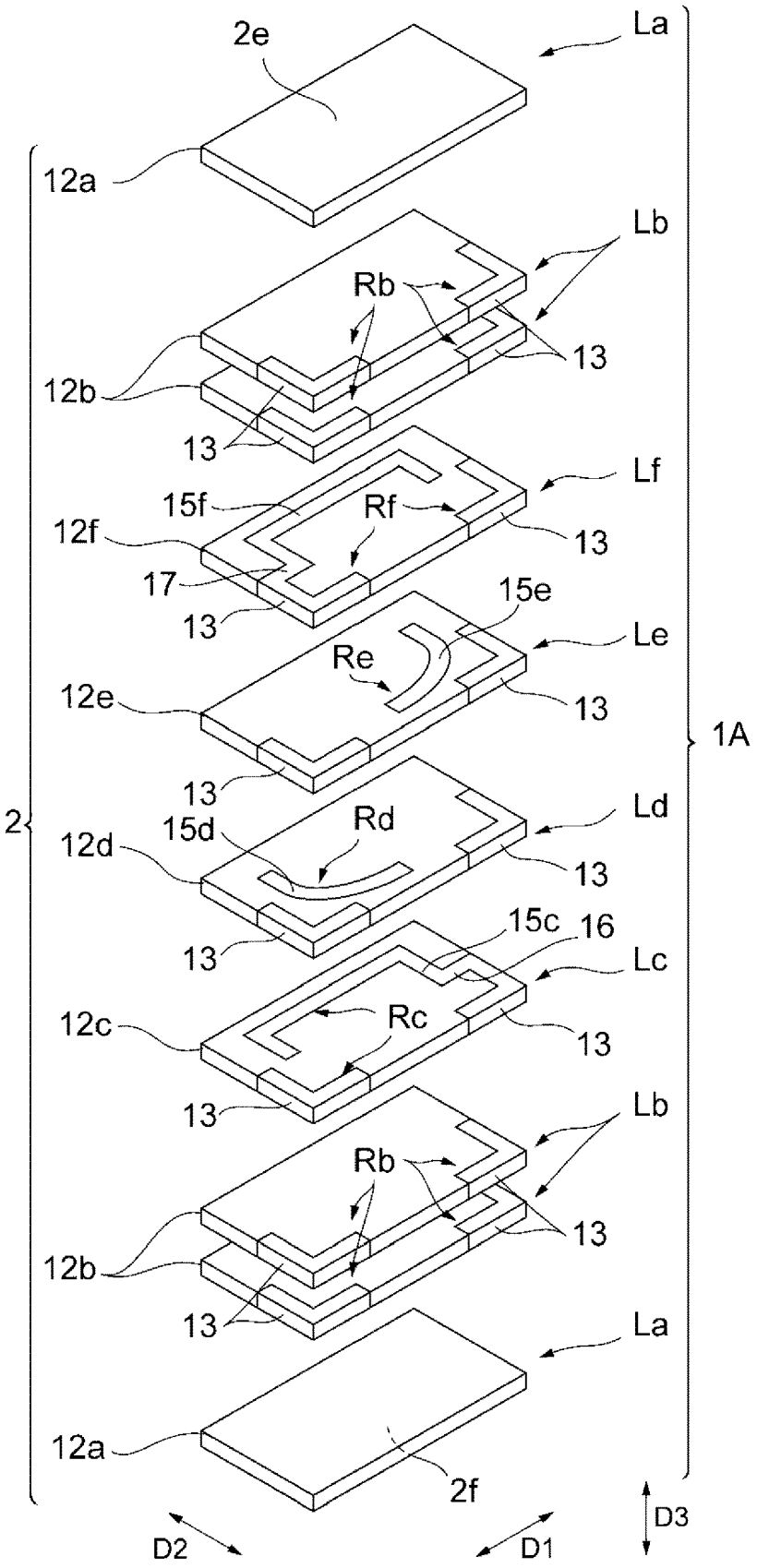
FIG. 4 is an exploded perspective view of a laminated coil component according to a second embodiment.
Figure 5:
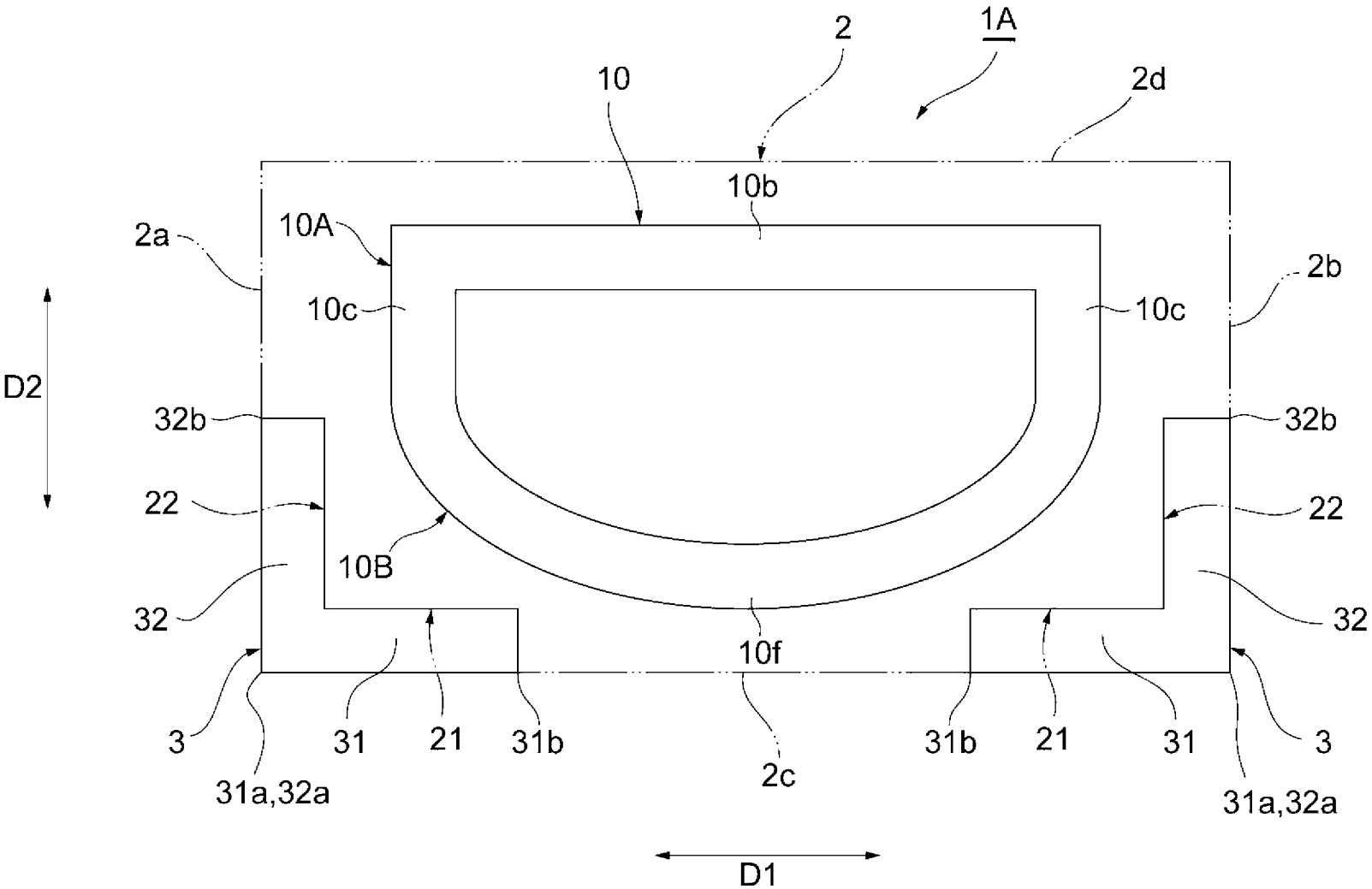
FIG. 5 is a side view of the laminated coil component in FIG. 4 when viewed from a direction along a coil axis.

With reference to FIGS. 4 and 5, a laminated coil component according to a second embodiment will be described. FIG. 4 is an exploded perspective view of a laminated coil component according to a second embodiment. FIG. 5 is a side view of the laminated coil component in FIG. 4 when viewed from a direction along a coil axis. In FIG. 5, an element body 2 is indicated by imaginary lines, the illustration of connecting conductors 6 and 7 is omitted, and a coil 10 is indicated by a contour when viewed from a direction D3, similarly to FIG. 3. As shown in FIGS. 4 and 5, a laminated coil component 1A according to the second embodiment mainly differs from the laminated coil component 1 (see FIG. 1) according to the first embodiment in the shape of the coil 10. The laminated coil component 1A will be described below focusing on differences from the laminated coil component 1.

In the laminated coil component 1A, the coil 10 includes a straight portion 10*b*, a pair of straight portions 10*c*, and a curved portion 10*f*. The curved portion 10*f* connects the pair of straight portions 10*c* to each other. Specifically, the end portion of the curved portion 10*f* at an end face 2*a* side is connected to the end portion of the one straight portion 10*c* at a side face 2*c* side. The end portion of the curved portion 10*f* at an end face 2*b* side is connected to the end portion of the other straight portion 10*c* at the side face 2*c* side. The curved portion 10*f* is disposed in the center portion of the element body 2 in a direction D1. The curved portion 10*f* is curved as a whole. The curved portion 10*f* has, in particular, an arcuate shape as a whole. A coil portion 10A includes the straight portion 10*b* and the pair of straight portions 10*c*. A coil portion 10B is formed by the arcuate curved portion 10*f*. The curved portion 10*f* is curved in such a way that the top portion of the curve is to be positioned between end portions 31*b* of the pair of conductors 3. Thus, the inner diameter of the coil 10 can be increased.

As described above, in the laminated coil component 1A, since the coil portion 10B has, in particular, an arcuate shape and does not include a corner portion, it is possible to further suppress signal reflection as compared with the laminated coil component 1.

Third Embodiment

Figure 6:
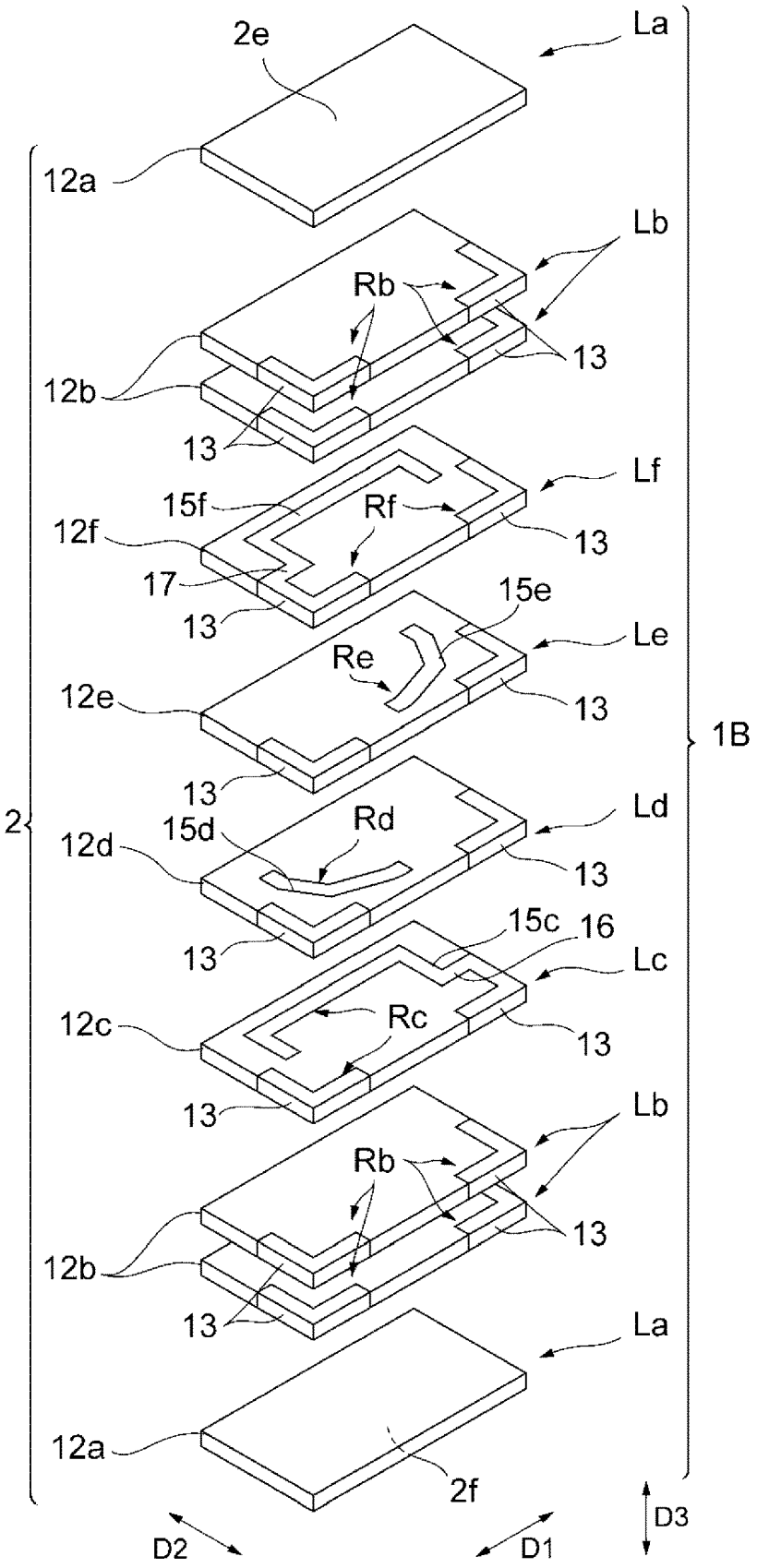
FIG. 6 is an exploded perspective view of a laminated coil component according to a third embodiment.
Figure 7:
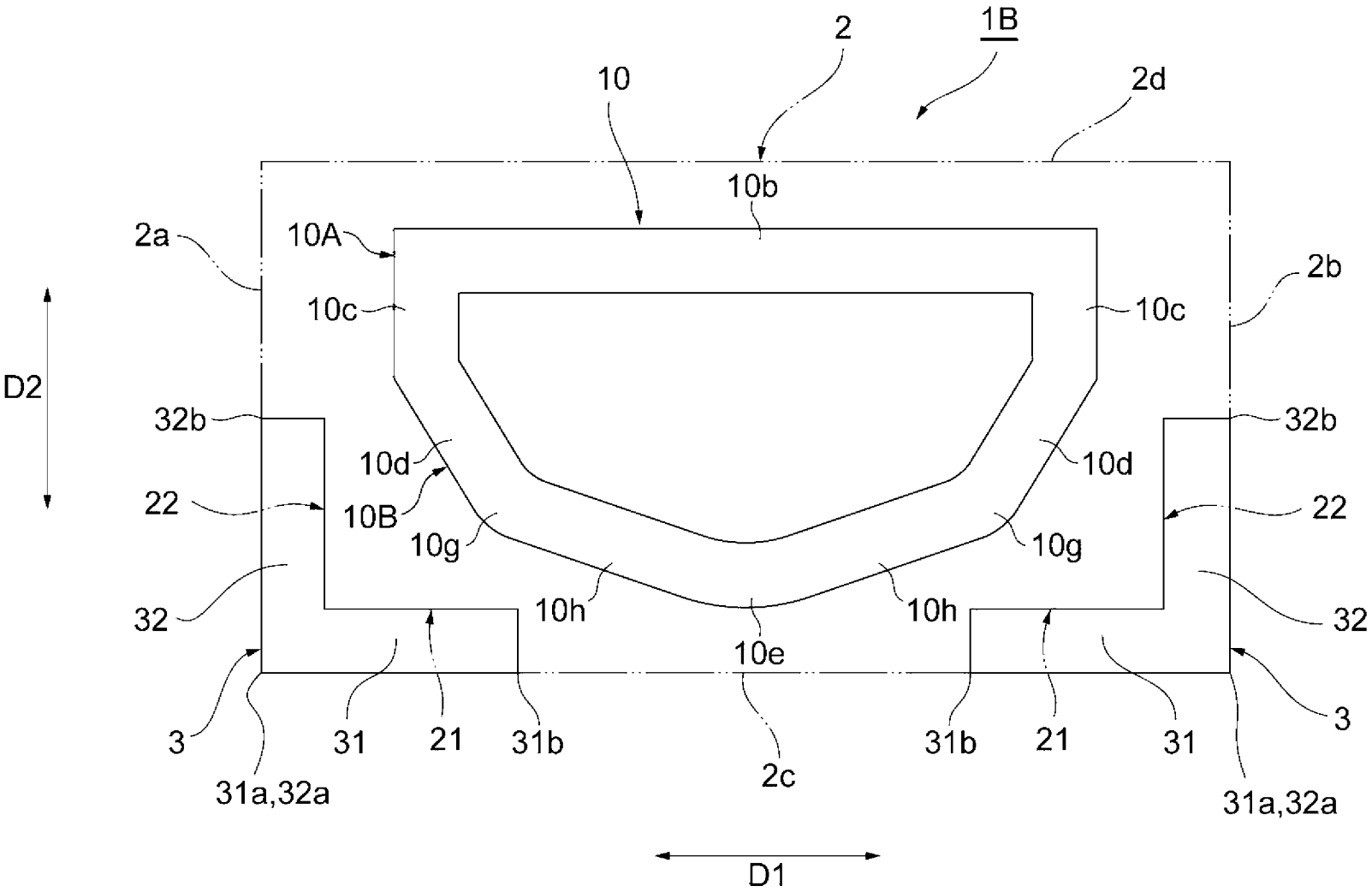
FIG. 7 is a side view of the laminated coil component in FIG. 6 when viewed from a direction along a coil axis.

With reference to FIGS. 6 and 7, a laminated coil component according to a third embodiment will be described. FIG. 6 is an exploded perspective view of a laminated coil component according to a third embodiment. FIG. 7 is a side view of the laminated coil component in FIG. 6 when viewed from a direction along a coil axis. In FIG. 7, an element body 2 is indicated by imaginary lines, the illustration of connecting conductors 6 and 7 is omitted, and a coil 10 is indicated by a contour when viewed from a direction D3, similarly to FIG. 3. As shown in FIGS. 6 and 7, a laminated coil component 1B according to the third embodiment mainly differs from the laminated coil component 1 (see FIG. 1) according to the first embodiment in the shape of the coil 10. The laminated coil component 1B will be described below focusing on differences from the laminated coil component 1.

In the laminated coil component 1B, the coil 10 includes a straight portion 10*b*, a pair of straight portions 10*c*, a pair of straight portions 10*d*, a pair of straight portions 10*h*, a curved portion 10*e*, and a pair of curved portions 10*g*.

The pair of curved portions 10*g* connects the pair of straight portions 10*d* to the pair of straight portions 10*h*. Specifically, one curved portion 10*g* connects one straight portion 10*d* to one straight portion 10*h*. The other curved portion 10*g* connects the other straight portion 10*d* to the other straight portion 10*h*. The pair of curved portions 10*g* is connected to the pair of straight portions 10*d*. Specifically, the end portion of the one curved portion 10*g* at the side face 2*d* side is connected to the end portion of the one straight portion 10*d* at the side face 2*c* side. The end portion of the other curved portion 10*g* at the side face 2*d* side is connected to the end portion of the other straight portion 10*d* at the side face 2*c* side. The pair of curved portions 10*g* has the same shape. Each curved portion 10*g* is curved in such a way that the top portion of the curve extend toward the end portion 31*a*, 32*a* of each conductor 3 and is positioned inside the L shape of each conductor 3. Thus, the inner diameter of the coil 10 can be increased.

The pair of straight portions 10*h* is connected to the pair of curved portions 10*g*. Specifically, the end portion of the one straight portion 10*h* at the side face 2*d* side is connected to the end portion of the one curved portion 10*g* at the side face 2*c* side. The end portion of the other straight portion 10*h* at the side face 2*d* side is connected to the end portion of the other curved portion 10*g* at the side face 2*c* side. Each of the pair of straight portions 10*h* has a linear shape and extends from the end portion of the pair of curved portions 10*g* at the side face 2*c* side to the side face 2*c*. The pair of straight portions 10*h* gradually approaches each other toward the side face 2*c*. Toward the side face 2*c*, the distance between the one straight portion 10*h* and the end face 2*a* in the direction D1 and the distance between the other straight portion 10*h* and the end face 2*b* in the direction D1 become longer. Each of the pair of straight portions 10*h* has the same shape.

The curved portion 10*e* connects, instead of the pair of straight portions 10*d*, the pair of straight portions 10*h* to each other. Specifically, the end portion of the curved portion 10*e* at the end face 2*a* side is connected to the end portion of the one straight portion 10*h* at the side face 2*c* side. The end portion of the curved portion 10*e* at the end face 2*b* side is connected to the end portion of the other straight portion 10*h* at the side face 2*c* side.

A coil portion 10A includes the straight portion 10*b*, the pair of straight portions 10*c*, and a part of the pair of straight portions 10*d*. A coil portion 10B is formed by a part of the pair of straight portions 10*d*, the pair of curved portions 10*g*, the pair of straight portions 10*h*, and the curved portion 10*e*, and is curved as a whole.

As described above, in the laminated coil component 1B, since the coil portion 10B further includes the pair of curved portions 10*g* and the pair of straight portions 10*h*, the shape of the coil portion 10B is much more flexible as compared to the laminated coil component 1 (see FIG. 1). Accordingly, it is possible to form the inner diameter of the coil 10 in such a way as to be larger than that of the laminated coil component 1 (see FIG. 1) while the coil portion 10B is away from the conductor 3 by a certain distance or more.

The present invention is not limited to the above embodiment, and various modifications can be made.

In the laminated coil components 1, 1A, and 18, the coil conductors 5*c*-5*f* may be connected to each other by, for example, through-hole conductors.

What is claimed is:

1. A laminated coil component comprising:

an element body including a first face and a second face opposed to each other in a first direction, a third face and a fourth face opposed to each other in a second direction orthogonal to the first direction, and a fifth face and a sixth face opposed to each other in a third direction orthogonal to the first direction and the second direction;

a coil including a plurality of coil conductors in the element body, wherein an axis of the coil is along the third direction; and a first conductor and a second conductor disposed on the element body and spaced apart from each other in the first direction, wherein the first conductor includes a first conductor portion extending in the first direction and a second conductor portion extending in the second direction, a first depression is disposed on the third face, and the first conductor portion is disposed in the first depression, a second depression is disposed on the first face, and the second conductor portion is disposed in the second depression and spaced apart from the fourth face, the second conductor includes a third conductor portion extending in the first direction and a fourth conductor portion extending in the second direction, a third depression is disposed on the third face, and the third conductor portion is disposed in the third depression, a fourth depression is disposed on the second face, and the fourth conductor portion is disposed in the fourth depression and spaced apart from the fourth face, the coil includes a first coil portion and a second coil portion when viewed from the third direction, the first coil portion is disposed closer to the fourth face than an end portion of the second conductor portion at a side of the fourth face in the second direction, the second coil portion is disposed closer to the third face than the end portion in the second direction, a shortest distance between the second coil portion and the first face in the first direction and a shortest distance between the second coil portion and the second face in the first direction both increase from the fourth face toward the third face, the second coil portion includes a curved portion in a first region when viewed from the third direction, the first region being located between the first conductor and second conductor when viewed from the second direction, and wherein the first coil portion is spaced apart from the second conductor portion and the fourth conductor portion in the first direction when viewed from the second direction.

2. The laminated coil component according to claim 1, wherein the curved portion has an arcuate shape, and the arcuate shape overlaps the first conductor and second conductor when viewed from the second direction.

3. The laminated coil component according to claim 1, wherein the first coil portion includes a portion that is continuous with the second coil portion, and the portion is disposed such that a shortest distance between the portion and the first face in the first direction and a shortest distance between the portion and the second face in the first direction both increase from the fourth face toward the third face.

4. The laminated coil component according to claim 1, wherein the plurality of coil conductors includes two coil conductors adjacent to each other in the third direction, and the two coil conductors are connected to each other at the curved portion.

5. The laminated coil component according to claim 1, wherein the second coil portion is spaced apart from a second region in the second direction, the second region being located between the first conductor portion and the third conductor portion in the first direction.

6. The laminated coil component according to claim 1, wherein the first coil portion includes a first straight portion, a second straight portion connected to a first end portion of the first straight portion, and a third straight portion connected to a second end portion of the first straight portion, the first straight portion is disposed along the fourth face when viewed from the third direction, the second straight portion is disposed along the first face when viewed from the third direction, and the third straight portion is disposed along the second face when viewed from the third direction.

7. The laminated coil component according to claim 1, wherein an apex of the curved portion is disposed, in the second direction, closer to the fourth face than the first conductor portion and the third conductor portion or at a same position in the second direction as inner edges of the first conductor portion and the third conductor portion.

* * * * *